United States Patent [19]

Cody, Jr.

[11] Patent Number: 4,933,547

[45] Date of Patent: Jun. 12, 1990

[54] METHOD FOR EXTERNAL CALIBRATION OF ION CYCLOTRON RESONANCE MASS SPECTROMETERS

[75] Inventor: Robert B. Cody, Jr., Madison, Wis.

[73] Assignee: Extrel FTMS, Inc., Madison, Wis.

[21] Appl. No.: 341,728

[22] Filed: Apr. 21, 1989

[51] Int. Cl.[5] ..... H01J 49/48

[52] U.S. Cl. ..... 250/282

[58] Field of Search ..... 250/282, 291, 252.1

[56] References Cited

U.S. PATENT DOCUMENTS

| | | | |
|---|---|---|---|
| 3,937,955 | 2/1976 | Comisarow et al. | 250/283 |
| 4,500,782 | 2/1985 | Allemann et al. | 250/291 |
| 4,581,533 | 4/1986 | Littlejohn et al. | 250/282 |
| 4,739,165 | 4/1988 | Ghaderi et al. | 250/290 |

OTHER PUBLICATIONS

M. Allemann et al., "Sidebands in the ICR Spectrum and their Application for Exact Mass Determination", *Chem. Phys. Lett.*, vol. 84.

K. Aoyagi, "Study of the Quasi-Peaks in the Ion Cyclotron Double Resonance", *Bull. Chem. Soc. Japan*, vol. 51, 1978, pp. 355–359.

R. B. Cody et al., "Fourier Transform Mass Spectrometry", Ch. 4, *Application of the Dual-Cell Fourier Transform Mass Spectrometer*, 1987, pp. 59–80.

M. B. Comisarow, "Cubic Trapped-Ion Cell for Ion Cyclotron Resonance", *Int. J. Mass Spectrom. Ion Physics*, vol. 37, 1981, pp. 251–257.

R. C. Dunbar et al., "Magnetron Motion of Ions in the Cubical ICR Cell", *Int. J. Mass Spectrom. Ion Proc.*, vol. 57, 1984, pp. 34–56.

B. S. Freiser et al., "Observation of Ion Ejection Phenomena in Ion Cyclotron Double Resonance Experiments", *Int. J. Mass Spectrom. Ion Physics*, vol. 12, 1973, pp. 249–255.

C. Giancaspro et al., "Mass Discrimination Based on Longitudinal Ion Motion in a Double-Cell Fourier Transform Ion Cyclotron Resonance Mass Spectrometer".

C. L. Johlman et al., "Accurate Mass Measurement Spectrometry", *Anal. Chem., vol. 57, No. 6, May 1985, pp. 1040–1044.*

E. B. Ledford Jr. et al., "Space Charge Effects in Fou- (List continued on next page.)

*Primary Examiner*—Jack I. Berman

*Attorney, Agent, or Firm*—Lathrop & Clark

[57] ABSTRACT

An ion cyclotron resonance mass spectrometer is externally calibrated, i.e. a calibrant compound is not present at the same time as the sample to be analyzed, by determining changes in the relative number of ions in the cell. This may be done by obtaining a spectrum of the sample to be analyzed, measuring the trapping sidebands, and then determining the trapping frequency from those sidebands as the difference between the trapping sideband frequencies and divided by four. The cyclotron frequency can then be found from the effective measured frequency and the trapping frequency, and the mass is then obtained as a function of the cyclotron frequency. Another approach is to measure the magnetron frequency directly, and then to calculate the cyclotron frequency from the measured effective frequency and the magnetron frequency. A third approach is to introduce a calibrant compound into the cell and produce several output signals with various relative numbers of ions. Calibration is accomplished by using the known relation $$m = K_1 B/F + K_2 E/f^2,$$

or variations thereof, where m is the mass of the ion to be measured, $K_1$ and $K_2$ are constants, B is the magnetic field strength, f is the measured frequency for that ion, and E is an electric field term which is dependent on the cell geometry, magnetic field strength, and total number of ions present in the cell. An output signal is obtained for the sample under analysis and, by knowing the relative number of ions that is to be incorporated into the E term, the values for the various factors can be inserted into the calibration relation to arrive at mass measurement values.

22 Claims, 5 Drawing Sheets

OTHER PUBLICATIONS rier Transform Mass Spectrometry. Mass Calibration", *Anal. Chem.*, vol. 56, No. 14, 1984, pp. 2744–2748.

M. Riggin, "Analysis of Ion Cyclotron Resonance Line Shapes", *Int. J. Mass Spectrom. Ion Physics*, vol. 22, 1976, pp. 35–41.

T. E. Sharp, et al., "Trapped-Ion Motion in Ion Cyclotron Resonance Spectroscopy", *Int. J. Mass Spectrom. Ion Physics*, vol. 9, pp. 421–439 (1972).

W. J. van der Hart et al., "Excitation of the Z-Motion of Ions in a Cubic ICR Cell", *Int. J. Mass Spectrom. Ion Proc.*, vol. 82, 1988, pp. 17–31.

R. L. White et al., "Exact Mass Measurement in the Absence of Calibrant by Fourier Transform Mass Spectrometry", *Anal. Chem.*, vol. 55, No. 2, 1983, pp. 339–343.

R. B. Cody et al., "Developments in Analytical Fourier-Transform Mass Spectrometry", *Analytica Chimica Acta*, vol. 178, 1985, pp. 43–66.

METHOD FOR EXTERNAL CALIBRATION OF ION CYCLOTRON RESONANCE MASS SPECTROMETERS

FIELD OF THE INVENTION

This invention relates generally to the field of mass spectrometry, and particularly to the calibration of an ion cyclotron resonance spectrometer.

BACKGROUND OF THE INVENTION

A mass spectrometer is an instrument which produces ions from a sample, separates the ions according to their mass-to-charge ratios by utilizing electric and magnetic fields, and provides output signals which are measures of the relative abundance of each ionic species present. The output signals are typically represented graphically such that the ion mass-to-charge ratios are shown on the x-axis, and the relative ion abundances are depicted on the y-axis to form a mass spectrum for the sample. The knowledge of the mass-to-charge ratios of the ions and the measured ion abundances allows a determination of the chemical composition of the sample molecules and their relative abundance.

It is desirable to calibrate the instrument to produce results with high mass-to-charge measurement accuracy and precision. This typically involves the introduction of a calibrant compound that produces ions of known mass-to-charge ratios in order to relate the measured mass-to-charge ratio to the known value for the calibrant compound. Current practice requires that for highly accurate measurements, the calibrant compound must be present at the same time as a measurement is to be made on a sample. This is often undesirable, since the calibrant peaks may interfere with the sample peaks to be measured. It is preferable to perform the calibration separately, and then make the sample measurement at a later time. This may be referred to as "external calibration," since the calibrant compound is not present in the mass spectrometer at the time that the sample is measured. This has been difficult or impossible to accomplish with conventional mass spectrometers (magnetic sector instruments) due to fluctuations and instabilities in the electric and magnetic fields employed by the mass analyzers.

In the calibration of ion cyclotron resonance (ICR) mass spectrometers, the measured frequency, f, can be related to the mass, m, of a given ion by the relation, $$m=k_1B/f+k_2E/f^2$$

where $k_1$ and $k_2$ are constants, B represents the magnetic field, and E represents the electric field experienced by the ions. See E. B. Ledford, Jr. et al., "Space Charge Effects in Fourier Transform Mass Spectrometry. Mass Calibration," *Anal. Chem.*, vol. 56, no. 14, 1984, pp. 2744–2748. If a superconducting magnet is employed, the magnetic field, B, is stable for long periods of time, and may be considered to be constant for all practical purposes. The electric field term is related to the ion-trapping cell geometry (i.e. the arrangement of electrodes used for confinement detection of ions), the potentials applied to the trapping plates (i.e. the electrodes placed perpendicular to the magnetic field), and the number of ions present in the ion trapping cell.

Since the cell geometry is fixed, and the potentials applied to the trapping plates may be controlled by the operator, the major source of instability in an external calibration results from changes in the number of ions from the time when the calibration is performed, to the time when the sample measurement is made. Methods for estimating the number of ions present in the cell have been proposed that are based on the total gas pressure and characteristics of the electron beam (current, path length, etc.). See R. L. White, et al., "Exact Mass Measurement in the Absence of Calibrant by Fourier Transform Mass Spectrometry," *Anal. Chem.*, vol. 55, no. 2, 1983, pp. 339–343. External calibration was demonstrated for cases where the calibration and sample measurement are made under conditions which produce approximately similar numbers of ions. See C. L. Johlman et al., "Accurate Mass Measurement in the Absence of Calibrant for Capillary Column Gas Chromatography/Fourier Transform Mass Spectrometry," *Anal. Chem.*, vol. 57, no. May 6, 1985, pp. 1040–1044. While these methods have enjoyed some success, they are not completely satisfactory. The former approach is dependent upon an estimate of the number of ions produced by a single ionization method (electron ionization), which may be subject to error. The second method relies upon the assumption that the number of sample ions is roughly the same as the number of calibrant ions. Often, this is not the case.

Another method for external calibration is based upon measurement of the frequency of the first upper sideband of the resonant frequency of the ion to be measured. See M. Allemann et al., "Sidebands in the ICR Spectrum and their Application for Exact Mass Determination," *Chem. Phys. Lett.*, vol. 84, no. 3, Dec. 15, 1981, pp. 547–551, and U.S. Pat. No. 4,500,782 entitled "Method of Calibrating Ion Cyclotron Resonance Spectrometers" and issued to Allemann et al. The frequency of this upper magnetron sideband is approximately equal to the true cyclotron frequency of the ion to be measured, and is not affected by changes in the trapping voltage. The magnetron sidebands to be measured are much smaller in intensity than the main peak, and usually require high resolution to separate them from the main sample peak. Alternatively, several calibrant masses may be measured, and the difference between the measured mass and the calculated cyclotron frequency is used as a correction factor to convert the measured frequency to the cyclotron frequency for an unknown ion.

Sidebands may also result from the coupling of cyclotron motion and trapping motion. See, e.g., B. S. Freiser, et al., "Observation of Ion Ejection Phenomena in Ion Cyclotron Resonance Experiments," *Int. J. Mass Spec. Ion Physics.*, vol. 12, 1973, pp. 249–255; K. Aoyagi, "Study of the Quasi-peaks in the Ion Cyclotron Double Resonance," *Bull. Chem. Soc. Japan*, vol. 51, 1978, pp. 355–359.

Excitation of the axis (trapping) motion of ions at frequencies which correspond to the frequencies for trapping sidebands has been observed. See W. J. van der Hart, et al., "Excitation of the Z-Motion of Ions in a Cubic ICR Cell," *Int. J. Mass Spec. Ion Proc.*, vol. 82, 1988, pp. 17–31.

SUMMARY OF THE INVENTION

In the present invention, an ion cyclotron resonance mass spectrometer is externally calibrated by accurately measuring changes in the number of ions from the ion signal itself. In accordance with the invention, it has been determined that the trapping frequency of an ion having a particular mass-to-charge ratio decreases linearly with the number of ions confined in the ion trapping cell. By obtaining a mass spectrum of the sample, the trapping sidebands found in the spectrum can be examined to determine the trapping frequency. The trapping frequency can be calculated as the difference of the trapping sideband frequencies divided by four. The cyclotron frequency may then be obtained by the relationship $$\omega_c=\omega_{eff}+(\omega_t^2/2\omega_{eff}),$$

where $\omega_c$ is the cyclotron frequency, $\omega_{eff}$ is the effective (measured) frequency, and $\omega_t$ is the trapping frequency. The cyclotron frequency may then be used to determine the mass of a particular ion, in accordance with the relationship $$\omega_c=qB/m,$$

where q is the ionic charge, B is the magnetic field strength, and m is the ionic mass. The use of the trapping frequency in this manner is advantageous because the trapping sidebands are well separated from the main peaks.

Because the frequency of the magnetron motion has a linear dependence on the number of ions confined in the trapping cell, a second method for measuring changes in the relative number of ions in the ion trapping cell involves a direct measurement of the magnetron frequency. The method of the present invention directly measures the magnetron frequency, $\omega_m$, from image currents induced in the receiver plates of the trapping cell. The true cyclotron frequency, $\omega_c$, may then be determined from the effective (measured) frequency, $\omega_{eff}$, by the equation $$\omega_c=\omega_{eff}+\omega_m$$

A third method uses measurements of the relative number of ions to correct the electric field term in the calibration equation $$m=k_1B/f+k_2E/f^2$$

in order to improve mass measurement accuracy and allow for external calibration. The determination of the relative number of ions may be accomplished by several methods. For example, a Fourier transform may be performed on the ion transient signal to extract the mass spectrum, and the abundances for all of the peaks may be summed to provide a measure of the total number of ions. A second method to determine changes in the total number of ions is to measure the magnetron frequency or amplitude for the magnetron or trapping frequencies of the ions contained in the trapping cell, since it has been established that these frequencies are proportional to the total number of ions in the cell. Where the signal consists of a single ion, another possibility is to measure the change in the signal amplitude, as the number of ions will be directly proportional to the amplitude.

The calibration is accomplished by collecting several spectra for the calibrant compound as the total number of ions is varied. The relative number of ions is determined for each spectrum, and the above calibration, or a derivation thereof, is used in the calibration process. Knowing the values for such variables as mass and frequency of the calibrant ion, the trapping voltage, and the magnetic field, the unknown variables may be calculated by the method of least squares or by plotting a calibration curve. Having determined the relationships between the different variables for the calibrant ion, the mass measurement can be determined for a sample to be analyzed by knowing the relationship between the relative number of ions and the unknown variables.

Further objects, features, and advantages of the invention will be apparent from the following detailed description taken in conjunction with the accompanying drawings.

DESCRIPTION OF THE PREFERRED EMBODIMENT

Figure 1:
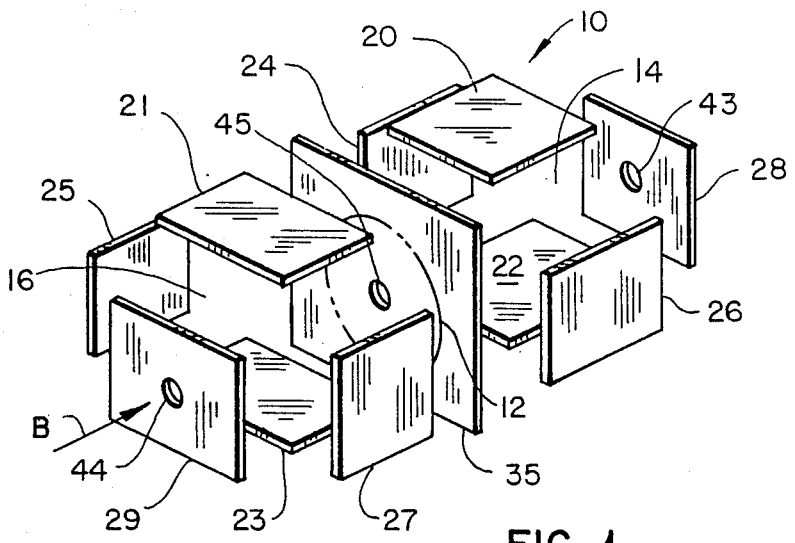
FIG. 1 is an exploded and partial cut-away view illustrating an exemplary ion trapping cell divided into multiple sections by a conductance plate.

With reference to the drawings, an exemplary ion cyclotron resonance (ICR) cell is shown at 10 in FIG. 1. The depicted embodiment of the cell is a dual-cell arrangement, the cell 10 having first and second sections, 14 and 16, that have an electrode 12 positioned between them. The cell 10 is maintained in a substantially constant and preferably uniform magnetic field, the direction of the magnetic field being indicated by the arrow B in FIG. 1. The cell 10 has top excitation electrodes 20 and 21 opposed by bottom excitation electrodes 22 and 23, side detector electrodes 24 and 25 opposed by side detector electrodes 26 and 27, and trapping plates 28 and 29 perpendicular to the magnetic field at the ends. The ICR cell 10 is shown as having a substantially rectangular cross-section with two sections, though single-cell and other multiple-cell arrangements, as well as alternate geometries such as cylindrical or hyperbolic, are known and may also be used in the practice of the present invention.

Figure 2:
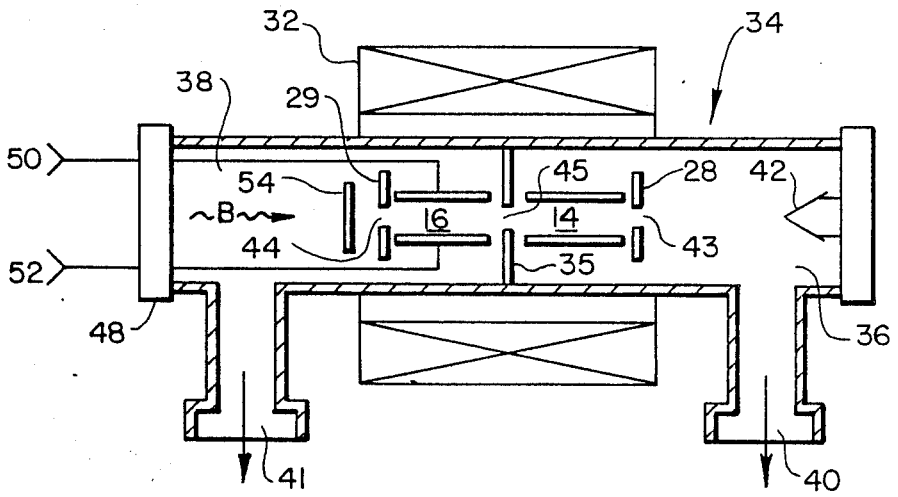
FIG. 2 is a schematic illustration of a vacuum chamber and magnet of an exemplary ion cyclotron resonance mass spectrometer.

FIG. 2 is a diagrammatic illustration of the exemplary ICR mass spectrometer. A solenoid magnet 32 encircles a spectrometer vacuum chamber 34 to induce the magnetic field B. Magnet configurations other than solenoid may also be used in the practice of the present invention. The solenoid magnet 32 is preferably a superconductive magnet to produce a stable magnetic field for long periods of time, typically producing a field of 3 Tesla. To maintain the superconductive effect, the solenoid magnet 32 is enclosed in a dewar and cooled by liquid helium. The electrode 12 is supported by an electrically isolated conductance limit plate 35 which divides the cell 10 of the present invention into the first section 14 and the second section 16, and also divides the vacuum chamber 34 into a first compartment 36 and a second compartment 38. Each compartment is connected to a high vacuum pump generally indicated by the arrows 40 and 41, and each compartment is typically pumped to a pressure in the $10^{-9}$ Torr region. The first compartment 36 of the vacuum chamber 34 contains an ion generating source 42, such as an electron gun, particle beam, laser, or other source, which will emit a beam that passes through apertures 43 and 44 of the trapping plates 28 and 29, and an orifice 45 of the conductance limit plate 35, to ionize a sample contained in either of the cell sections. Substances such as sample and reagent gases may be introduced through a flange 48 as indicated at inlets 50 and 52 and may be carried by appropriate plumbing into the ionizing region. That region may also contain an electron collector 54, in known manner. Ionization of the sample may also be performed in a region outside of the cell and the sample ions may be introduced into the cell by various means. See, e.g., U.S. Pat. No. 4,739,165 entitled "Mass Spectrometer with Remote Ion Source" issued to S. Ghaderi, O. Vorburger, D. P. Littlejohn, and J. L. Shohet.

In operation, a sample to be analyzed is introduced into the second section 16 of the cell 10 contained within the second compartment 38. With ions formed within the cell section 16, and in the presence of a magnetic field, ion cyclotron resonance will be established, in a known manner. By the proper application of a DC potential to the trapping plates 28 and 29, those plates will restrict ion movement to the region between them along the magnetic field. The other electrodes of the cell 10 may be neutral or slightly polarized. Other construction details and operation of ICR cells is well-described elsewhere in various technical papers and patents, for example, in U.S. Pat. No. 4,581,533 issued to Littlejohn et al., and need not be further described here to illustrate the present invention.

It has been observed in ion cyclotron resonance spectrometry that the effective (measured) frequency $\omega_{eff}$ is shifted from the true cyclotron frequency $\omega_c$ in a fashion described by T. E. Sharp et al., "Trapped-Ion Motion in Ion Cyclotron Resonance Spectroscopy," *Int. J. Mass Spec. Ion Physics.*, vol. 9, pp. 421–439 (1972) as:

$$\omega_{eff}=(\omega_c^2-\omega_t^2)^{\frac{1}{2}}$$

where $\omega_t$ refers to the trapping oscillation frequency for the ions (the frequency at which the ions move back and forth along the direction of the magnetic field between the trapping plates). A more exact relationship is given by W. J. van der Hart et al., "Excitation of the Z-Motion of Ions in a Cubic ICR Cell," *Int. J. Mass Spec. Ion Proc.*, vol. 82, pp. 17–31 (1988) as:

$$\omega_{eff}=\tfrac{1}{2}[\omega_c+(\omega_c^2-2\omega_t^2)^{\frac{1}{2}}]$$

In that article, it is also shown that the frequency of the magnetron motion (a low frequency precessive motion in the same plane as the cyclotron motion) is given by:

$$\omega_m=\tfrac{1}{2}[\omega_c-(\omega_c^2-\omega_t^2)^{\frac{1}{2}}]$$

Therefore, it is apparent that the effective frequency is the cyclotron frequency minus the magnetron frequency:

$$\omega_{eff}=\omega_c-\omega_m$$

The present invention encompasses methods for external calibration of an ICR mass spectrometer by monitoring features of the ion signal that reflect changes in the number of ions confined in the ion trapping cell. Several different approaches may be taken. One such approach involves the measurement of the frequencies of sidebands resulting from the coupling of cyclotron motion and trapping motion.

In ion cyclotron resonance spectrometry, small peaks are often observed at frequencies slightly higher or lower than the main peak for ions of a given mass-to-charge ratio. These smaller peaks are referred to as 'sidebands," and result from the coupling of the three different types of ion motion in the ion trapping cell, i.e. the cyclotron, magnetron, and trapping motions. A calibration procedure based upon the use of sidebands resulting from the coupling of cyclotron and magnetron motion has been described. See M. Allemann et al., "Sidebands in the ICR Spectrum and their Application for Exact Mass Determination", *Chem. Phys. Lett.*, vol. 84, no. 3, Dec. 15, 1981, pp. 547–551, and U.S. Pat. No. 4,500,782 entitled "Method of Calibrating Ion Cyclotron Resonance Spectrometers" and issued to Allemann et al. Sidebands resulting from the coupling of magnetron motion and cyclotron motion are often of low abundance and require high resolution to separate them from the main peak.

Sidebands may also result from the coupling of cyclotron motion and trapping motion. It is found that the trapping sidebands have frequencies that are the effective frequency plus or minus twice the trapping frequency, i.e., $$\omega_{eff}+2\omega_t$$

and $$\omega_{eff}-2\omega_t.$$

Figure 4:
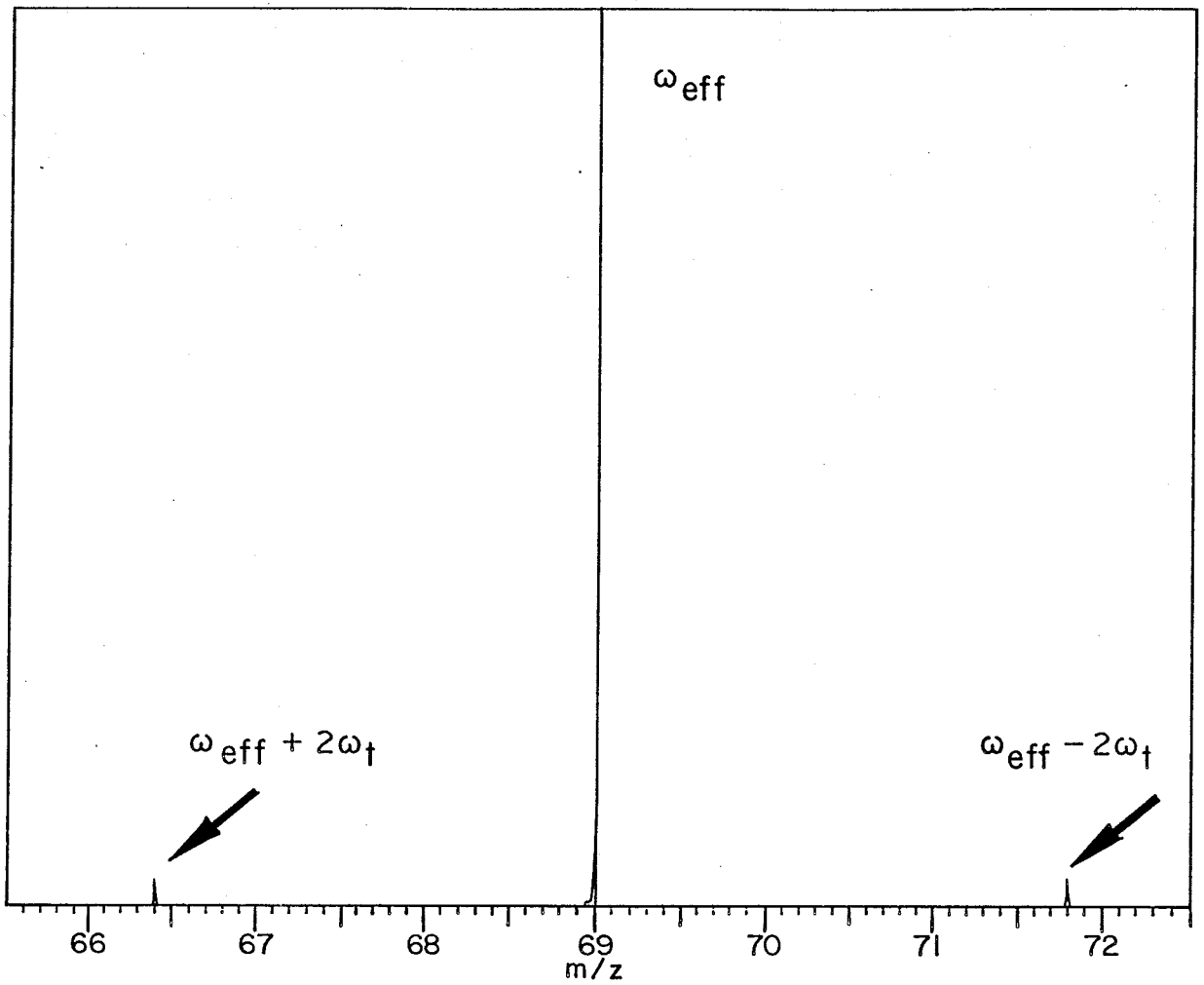
FIG. 4 shows the trapping sidebands for $CF_3^+$ produced by electron ionization of perfluorotributylamine.

FIG. 4 shows a trapping sidebands for the case of $CF_3^+$ produced by electron ionization of perfluorotributylamine. Each sideband depicted in FIG. 4 is separated from the main peak (the effective cyclotron frequency) by 26.32 kHz. To determine the trapping frequency for ions of a particular mass, the difference between the trapping sideband frequencies may be taken and divided by four to obtain the trapping frequency. For the example given in FIG. 4, the trapping frequency is 13.16 kHz.

Figure 5:
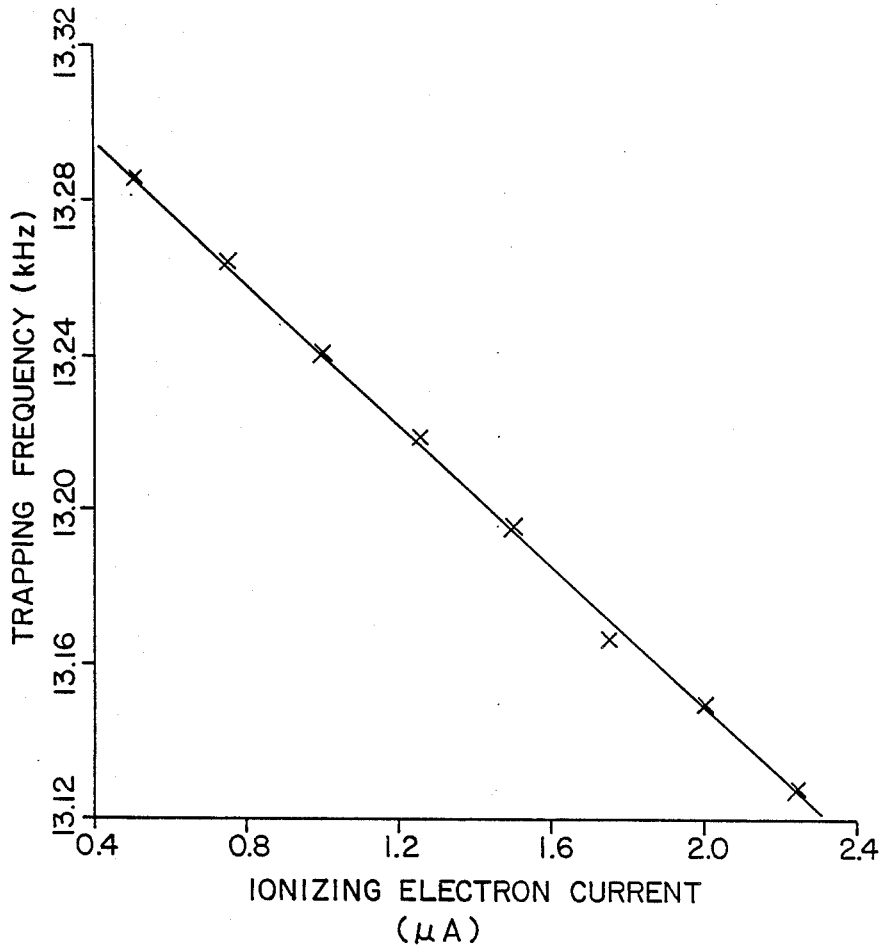
FIG. 5 shows a plot of the trapping frequency for $CF_3^+$ from electron-ionized perfluorotributylamine as the ionizing electron current is varied.

By monitoring the trapping frequency in this manner, at different pressures and different ionizing electron beam currents, it was determined that the trapping frequency is dependent on the number of ions in the cell, and that this frequency decreases linearly with the number of ions. FIG. 5 shows a plot of trapping frequency for $CF_3^+$ from electron-ionized perfluorotributylamine as the ionizing current is varied. The trapping frequency was determined from the frequencies of the trapping sidebands; the ionizing electron current is directly proportional to the number of ions confined in the ion trapping cell. Measurement of the trapping frequency may then be used to monitor and correct for changes in the number of ions in the cell that affect the accuracy of calibration and mass measurement. To calculate the true cyclotron frequency from the effective frequency and the trapping frequency measured from the trapping sidebands, the following relation may be derived:

$$\omega_c=\omega_{eff}+(\omega_t^2/2\omega_{eff}).$$

The value of the cyclotron frequency calculated in this manner may be used to accurately determine the mass of an unknown sample. In addition, the cyclotron frequency thus calculated for a calibrant ion may be used to accurately determine the magnetic field strength.

Because of the fact that $$\omega_c = \omega_{eff} + \omega_m$$

the term $$\omega_t^2/2\omega_{eff}$$

is equivalent to the magnetron frequency. Therefore, a variation of this calibration method uses the trapping sidebands for any given ion to determine the magnetron frequency. The true cyclotron frequencies for all other ions are obtained by adding the magnetron frequency thus calculated to the effective frequency for each ion.

Figure 6:
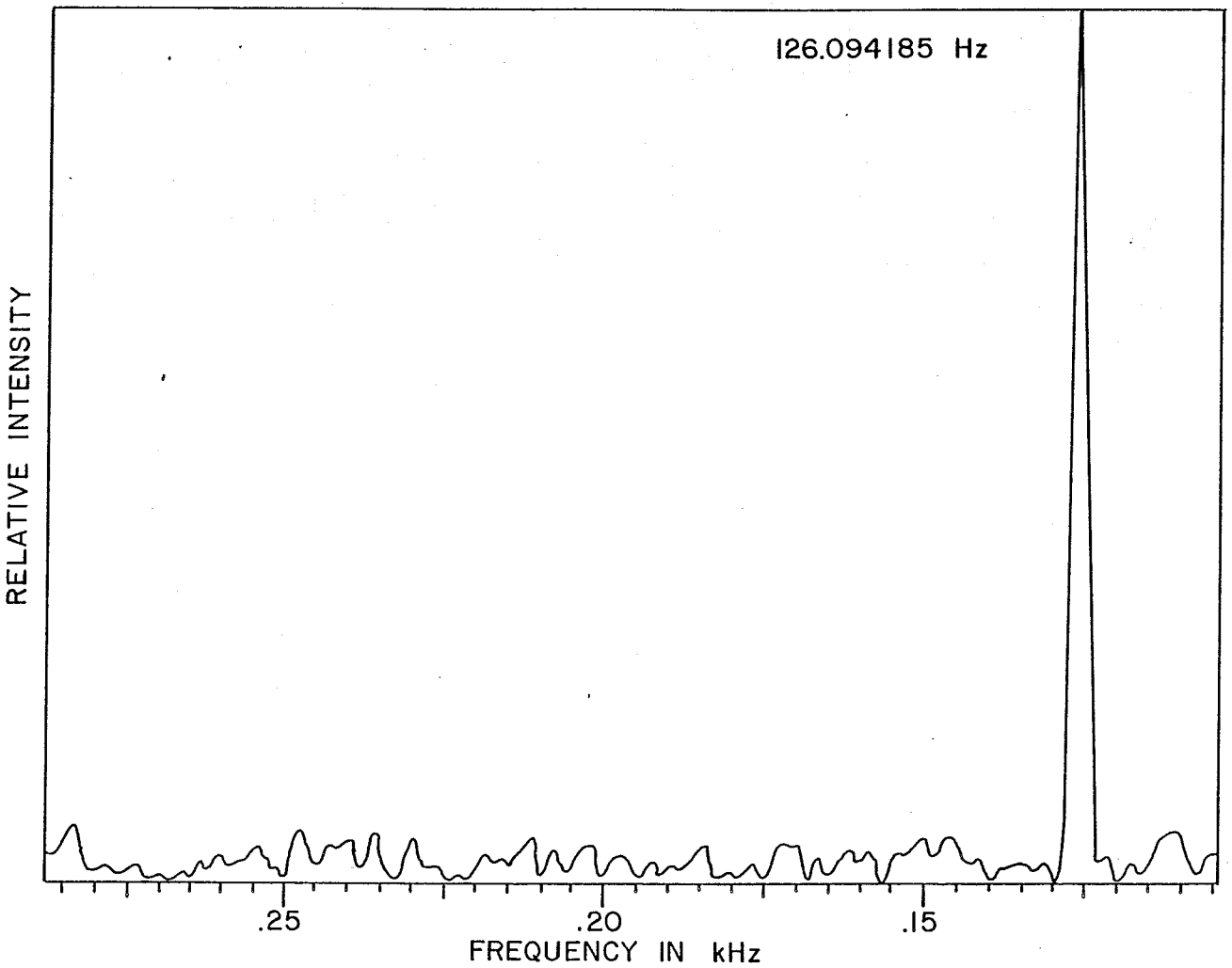
FIG. 6 shows direct detection of the magnetron motion for ions generated by electron ionization of perfluorotributylamine.

Another approach utilizing changes in the number of ions during the calibration of an ICR mass spectrometer involves direct measurement of the magnetron frequency. The magnetron frequency may be measured directly by detecting the ion transient signal before it passes through any high filter stages of the signal detection electronics. FIG. 6 shows an example of direct detection of magnetron motion for the case of ions generated by electron ionization of perfluorotributylamine. The magnetron frequency can also be measured indirectly, e.g. by monitoring peak height variations as a function of ion trapping time. See M. B. Comisarow, "Cubic Trapped-Ion Cell for Ion Cyclotron Resonance," *Int. J. Mass Spectrom. Ion Physics.*, vol. 37, 1981, pp. 251–257, and C. Giancaspro, F. R. Verdun, *Anal. Chem.*, vol. 58, 1986, pp. 2097–2099. The magnetron frequency is shifted by changes in the number of ions and, as noted above, along with the measured (effective) frequency, the magnetron frequency may be used to calculate the cyclotron frequencies for ions having unknown masses. This approach does not require that sidebands be located (the sidebands may have very low relative abundances), and it does not require a calibration compound to be present.

A third approach measures changes in the relative number of ions and uses these measurements to correct the electric field term in the calibration equation proposed by Ledford, et al. (E. B. Ledford, Jr. et al., "Space Charge Effects in Fourier Transform Mass Spectrometry. Mass Calibration," *Anal. Chem.* vol. 56, no. 14, 1984, pp. 2744–2748):

$$m = k_1 B/f + k_2 E/f^2$$

where m is the mass of the ion to be measured, $k_1$ and $k_2$ are constants, B is the magnetic field, f is the measured frequency for that ion, and E is the electric field term, which is dependent on the cell geometry, the potentials applied to the plates, and the total number of ions present in the cell.

As applied to the calibration equation, changes in the relative number of ions may be determined from the ion signal in various ways. The preferred method for measuring changes in the total number of ions involves measurement of the magnetron frequency of the ions contained in the trapping cell. The magnetron motion (also referred to as the drift motion) of the ions is a circular motion of the ions in the same plane as the cyclotron motion of the ions, and it has a much lower frequency than the cyclotron motion (i.e., in a range of a few hundred Hertz compared to several KiloHertz). The magnetron motion may be detected as a component of the image currents detected on the detector plates of the ICR cell 10. It was established that all of the ions contained in the cell 10 undergo coherent magnetron motion at a frequency that is related to the trapping potential, and which is proportional to the number of ions in the cell 10. See R. C. Dunbar et al., "Magnetron Motion of Ions in the Cubical ICR Cell," *Int. J. Mass Spectrom. Ion Proc.*, vol. 57, 1984, pp. 39–56. Therefore, changes in the relative number of ions may be detected by monitoring changes in either the amplitude or frequency of the magnetron motion. Changes in the relative number of ions may be detected in other ways as well. A Fourier transform may be performed on the ion transient signal to extract the mass spectrum. The abundances for all of the peaks may be summed to provide a measure of the total number of ions. The summation of the peak abundances may be determined by calculating the square root of the sum of the squares of the intensities of each data point in the frequency domain spectrum. This value may be compared with the total number of ions in another experiment, provided that the experimental conditions (e.g., gain, number of co-added transients, etc.) are known for both experiments. Other methods of determining the relative number of ions from the ion transient signal may be envisioned. For example, if the sample consists of a single ion, which produces a large signal, then the change in the number of ions will be directly proportional to the signal amplitude.

Once a method for measuring relative ion current, i', from the ion signal is selected, calibration may be accomplished in a straightforward manner. The calibration equation may be expressed as $$m = k_1 B/f + k_2' i' T/f^2$$

where T is the trapping voltage, $K_1$ is a constant from the standard calibration equation, $k_2'$ is a constant which contains $k_2$ from the standard calibration equation, and the electric field dependence on cell geometry and i' is the relative number of ions, m is the known mass for the calibrant ion, and f is the measured frequency. In order to perform an external calibration, the calibrant compound is introduced and several spectra are collected as the total number of ions is varied. The relative ion current is determined for each spectrum. The method of least squares may be used to determine the values of $k_1$ and $k_2'$. For the sample to be measured, the value obtained for the relative number of ions of the sample may be substituted for i' to obtain improved mass measurement accuracy.

An equivalent approach is employed in the illustrative embodiments in which the trapping voltage is kept constant. The calibration equation is rewritten as $$m = k_1 B/f + k_2'' T'/f^2$$

Where $k_2''$ is a constant related to the cell geometry and T' is a composite of the terms related to the trapping voltage and the total number of ions. This term, which may be referred to as the "effective trapping voltage" can be determined by calculating which value of the trapping voltage would have to be substituted in the original form of the calibration equation to make the measured mass for a calibrant ion exactly equal to the true mass.

If several calibrant spectra are collected, for different total ion numbers, a calibration curve may be created which relates the relative number of ions (measured as described above) with the effective trapping voltage. For the unknown sample, this calibration curve is used to determine the appropriate value of T' from the relative number of sample ions. The method of the present invention does not require that the absolute number of ions be determined, but only that relative values be determined for the number of ions.

The calibration procedure may be outlined as follows:

1. For a selected number of spectra of the calibrant compound:
   a. vary the number of ions (change the ionizing electron current or the calibrant compound pressure).
   b. calculate the relative ion abundances from the mass spectral peak intensities, from the magnetron signal, or from the trapping frequencies.
   c. calculate the effective trap voltage required to compensate for shifts in the calibrant ion frequencies.
2. Plot the effective trap voltage vs. the relative ion current for all calibrant spectra.
3. Collect the sample (unkown) spectrum
4. Determine the relative ion current (as done for the calibrant in lb).
5. Determine the effective trap voltage from the plot of effective trap voltage vs. the relative ion current constructed for the calibrant spectra (in 2).
6. Correct the calibration for the effective trap voltage determined in 5.
7. By using the corrected calibration, measure the unknown mass.

EXAMPLES

The measurements described below were carried out using a dual-cell Fourier transform mass spectrometer with a superconducting magnet, as described in R. B. Cody et al., "Developments in Analytical Fourier-Transform Mass Spectrometry," *Analytica Chimica Acta,* vol. 178, 1985, pp. 43–66; See also U.S. Pat. No. 4,581,533, which is incorporated herein by reference. Three examples are provided. The first demonstrates the use of trapping sidebands to calculate the cyclotron frequency. In the second example, a direct measurement of the magnetron frequency is used to calculate cyclotron frequencies. The third example illustrates how measurements of relative ion numbers may be used to correct the electric field term in the calibration equation.

In the first example, three separate measurements of the trapping sidebands for $CF_3^+$ from electron-ionized perfluorotributylamine were used to determine the true cyclotron frequency for that ion. The magnetic field strength was then calculated from $$B = m\,\omega_c/q$$

to be 3.023142 Tesla.

Perfluorotributylamine was removed from the inlet system and reintroduced one day later. The trapping sidebands for $C_3F_5$ in the electron-ionization mass spectrum were used to calculate the magnetron frequency as $$\omega_m = \omega_t^2/2\omega_{eff}$$

This frequency was used to calculate the true cyclotron frequencies for five ions; the true cyclotron frequency for each ion was used to accurately measure its mass. The results are summarized in the table below.

In a second example, the magnetron frequencies were measured by monitoring variations in peak height with ion-trapping time (See M. B. Comisarow, "Cubic Trapped-Ion Cell for Ion Cyclotron Resonance," *Int. J. Mass Spectrom. Ion Physics.,* vol. 37, 1981, pp. 251–257). Parabromofluorobenzene was first used as an external calibration compound to calculate the magnetic field strength, and the mass-to-charge ratio of the molecular ion of n-butylbenzene was then accurately measured.

The magnetron frequency for electron-ionized parabromofluorobenzene was found to be 121.560374 Hz at a trapping potential of 2.0 volts. The effective (measured) frequency, $\omega_{eff}$ for the $^{79}Br$ isotope of the molecular ion was 267.117697 kHz, and the theoretical calculated mass was 173.94749 u. The true cyclotron frequency $\omega_c$ for the molecular ion is the sum of the effective frequency and the magnetron frequency, or 267.239257 kHz. From this value, the magnetic field strength B was calculated from $$B = m\,\omega_c/q$$

(where q is the electronic charge) to be 3.02694388 Tesla.

The magnetron frequency for electron-ionized n-butylbenzene was measured to be 107.113000 Hz at a trapping potential of 1.75 volts. The effective frequency for the molecular ion was 346.518060 kHz. The cyclotron frequency for the molecular ion is the sum of these two values, or 346.625173 kHz. By using the magnetic field strength of 3.02694388 Tesla calculated for parabromofluorobenzene, the measured mass of the molecular ion of n-butylbenzene was determined to be 134.10912 u, a deviation of only 0.8 parts-per-million from the theoretical calculated value of 134.109001 u.

PFTBA ions measured 24 hours after calibration (using trapping sidebands method)

| Theoretical Mass (u) | Measured Mass (u) | Deviation (ppm) |
|---|---|---|
| 68.99467 | 68.99453 | −2.0 |
| 99.99307 | 99.99327 | 2.0 |
| 118.99147 | 118.99197 | 4.3 |
| 130.99149 | 130.99191 | 3.2 |
| 218.98511 | 218.98722 | 9.6 |
| | Average deviation: (Absolute values) | 4.2 |

Figure 3:
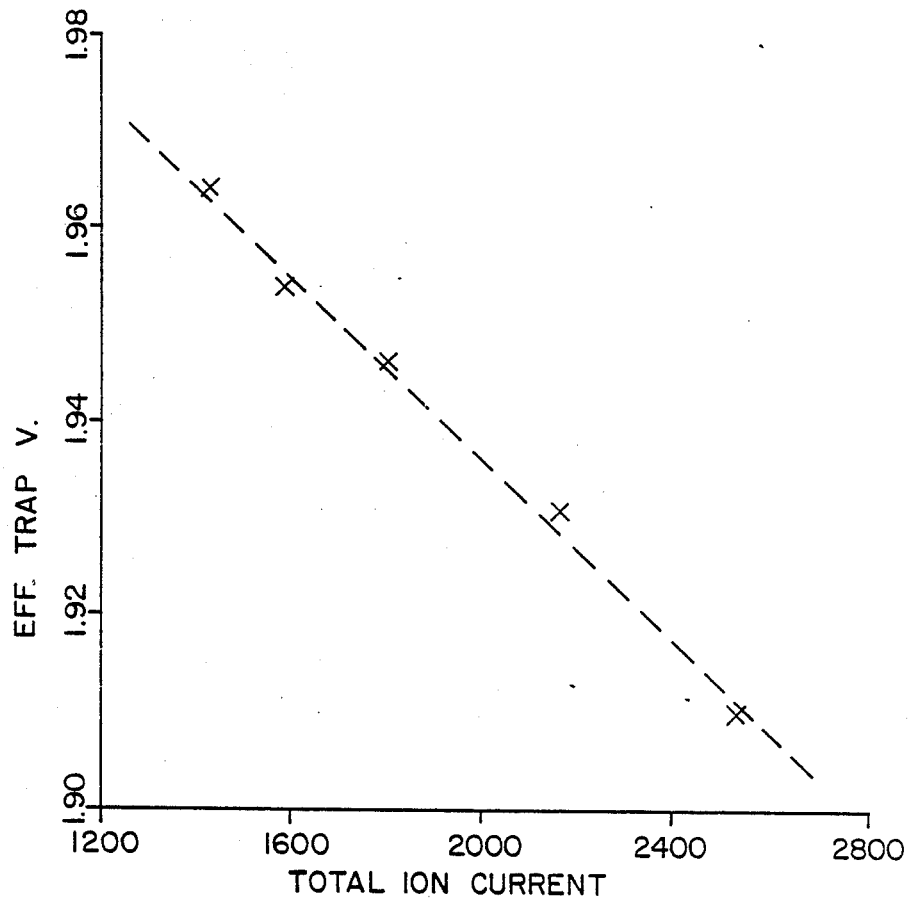
FIG. 3 shows a calibration curve relating the relative number of ions (or ion current) to the electric field for the example given in the specification.

In the calibration of the instrument for the third example, perfluorotributylamine (PFTBA) was employed as a calibrant compound. The trapping voltage and all gain settings were kept constant throughout the experiment. Five successive spectra were collected at an applied trapping voltage of 2.0 V, by varying the total number of ions by successively changing the current of the ionizing electron beam. For each spectrum, the relative number of ions was calculated by performing a Fourier transform on the first 2048 data points of the ion transient signal and calculating the square root of the sum of the squares of the data points. An overall value for the effective trapping voltage was calculated for each spectrum by taking an average of the effective trapping voltages calculated for several calibrant ions across the spectrum. An illustrative calibration curve that relates to the relative number of ions to the effective trapping voltage is shown in FIG. 3.

Ten ions in the mass spectrum of PFTBA were measured after 5.5 hours had elapsed. The results are set forth in the table below.

| PFTBA ions measured 5.5 hours after calibration Deviation of Measured Mass From Calculated Mass (PPM) | | |
|---|---|---|
| Nominal Mass | With Correction | Without Correction |
| 69 | 0.80 | 2.87 |
| 100 | −4.70 | −1.92 |
| 119 | −5.53 | −2.23 |
| 131 | −0.96 | 2.68 |
| 219 | 4.81 | 10.92 |
| 264 | 1.25 | 8.59 |
| 414 | 1.42 | 12.93 |
| 464 | −2.06 | 10.85 |
| 502 | 0.30 | 14.27 |
| 614 | −4.52 | 12.58 |
| | Avg. deviation = 2.6 (Absolute values) | 8.0 |
| | Acetophenone ions | |
| 77 | 0.72 | 5.94 |
| 105 | 0.02 | 7.13 |
| 120 | −2.98 | 5.15 |
| | Avg. deviation = 1.24 | 6.073 |

With the correction to the electric field, the average mass error was 2.6 parts per million, compared to the value of 8.0 parts per million which would be obtained without the correction. To demonstrate the improvement in mass measurement accuracy for ions from a sample other than PFTBA, three ions from acetophenone were also measured. The average mass error was found to be only 1.24 ppm, compared to the value 6.07 ppm that would be obtained without the correction. After three days had elapsed, a measurement of 12 peaks in the mass spectrum of perfluorobutyltetrahydrofuran was found to have an average mass error of only 2.59 parts per million, after applying the correction to the electric field term. These experiments confirm the improvement in accuracy of mass measurements obtained by the method of the invention for measurements made in the absence of an internal calibrant.

It is understood that the invention is not confined to the particular embodiments herein illustrated and described, but embraces such modified forms thereof as come within the scope of the following claims.

What is claimed is:

1. A method for performing calibrated measurements in an ion cyclotron resonance mass spectrometer of the type that has a cell into which a sample may be introduced, an ion generating source that produces ions which are trapped in the cell, means for producing a magnetic field in the cell, a plurality of electrode plates for exciting ion motion, and means for detecting motion of ions in the cell and providing an output signal indicative thereof, the method comprising the steps of:

(a) ionizing a sample to be analyzed and trapping the ionized sample in the cell of the ion cyclotron resonance mass spectrometer;

(b) exciting ion cyclotron resonance of the ionized sample and collecting a spectrum that represents the output signal indicative of the motion of ions of the sample to be analyzed in the cell;

(c) determining a quantity related to the relative number of ions in the cell from the spectrum collected;

(d) calculating the mass of the ions in the sample from the cyclotron frequency obtained from the spectrum and the physical conditions in the cell, corrected by a function of the quantity related to the relative number of ions in the sample.

2. The method of claim 1 wherein the steps of determining the relative number of ions in the cell includes determining the frequencies of trapping sidebands in the spectrum representing the combination of the cyclotron and trapping ion motions.

3. The method of claim 2 further comprising the step of determining the effective frequency of the ion cyclotron resonance in the spectrum and including the step of determining the trapping frequency by taking the difference between the trapping sideband frequencies and dividing by four, and wherein the cyclotron frequency is obtained by the relation $$\omega_c=\omega_{eff}+(\omega_t^2/2\omega_{eff})$$

where $\omega_c$ is the cyclotron frequency, $\omega_{eff}$ is the effective frequency, and $\omega_t$ is the trapping frequency, and wherein the mass is then obtained by the relation $$\omega_c=qB/m$$

where q is the ionic charge, B is the magnetic field strength, and m is the mass.

4. The method of claim 2 further comprising the step of determining the effective frequency of the ion cyclotron resonance in the spectrum and of determining the trapping frequency by taking the difference between the trapping sideband frequencies and dividing by four, and wherein the magnetron frequency is obtained by the relation.

$$\omega_m=\omega_t^2 2\omega_{eff}$$

and wherein the cyclotron frequency is obtained by the relation $$\omega_c=\omega_{eff}+\omega_m$$

where $\omega_c$ is the cyclotron frequency, $\omega_{eff}$ is the effective frequency, $\omega_t$ is the trapping frequency, and $\omega_m$ is the magnetron frequency, and wherein the mass is then obtained by the relation $$\omega_t=qB/m$$

where q is the ionic charge, B is the magnetic field strength and m is the mass.

5. The method of claim 1 wherein the steps of determining a quantity related to the relative number of ions in the cell includes a measurement of the magnetron frequency of the ions from the spectrum.

6. The method of claim 1 wherein the measurement of the magnetron frequency of the ions from the spectrum is a direct measurement.

7. The method of claim 1 wherein the measurement of the magnetron frequency of the ions from the spectrum is an indirect measurement.

8. The method of claim 7 wherein the magnetron frequency is indirectly measured by monitoring peak height variations as a function of ion trapping time.

9. The method of claim 5 further comprising the step of measuring the effective frequency of the ion cyclotron resonance, and wherein the cyclotron frequency is obtained by the relation $$\omega_c = \omega_{eff} + \omega_m$$

where $\omega_c$ is the cyclotron frequency, $\omega_{eff}$ is the effective frequency, and $\omega_m$ is the magnetron frequency, and wherein the mass is then obtained by the relation $$\omega_c = qB/m$$

where q is the ionic charge, B is the magnetic field strength, and m is the mass.

10. A method for performing calibrated sample measurements in an ion cyclotron resonance mass spectrometer of the type which has a cell into which a sample may be introduced, an ion generating source which produces ions which are trapped in the cell, means for producing a magnetic field in the cell, a plurality of electrode plates for exciting ion motion, and means for detecting motion of ions in the cell and providing an output signal indicative thereof, the method using the calibration relation:

$$m = k_1 B/f + k_2 E/f^2$$

where m is the mass of the ion to be measured, $k_1$ and $k_2$ are constants, f is the measured frequency for that ion, B is the magnetic field strength and E is an electric field term dependent on the cell geometry, the potentials applied to the trapping plates, and the total number of ions present in the cell, the method comprising the steps of:

(a) ionizing a calibrant compound and trapping the ionized calibrant compound in the cell of the ion cyclotron resonance mass spectrometer;
(b) exciting the ions into coherent cyclotron motion and collecting at least two spectra of the calibrant compound from the output signal indicative of the motion of ions of the calibrant compound in the cell;
(c) determining the relative number of ions in each of the spectra;
(d) removing the calibrant compound from the cell and ionizing a sample to be analyzed and trapping the ionized sample in the cell;
(e) exciting the ions into coherent cyclotron motion and collecting a spectrum of the sample to be analyzed;
(f) determining the relative number of ions in the spectra from the sample to be analyzed with respect to the relative number of ions determined from the spectra of the calibrant compound; and
(g) determining the mass of the sample ions from the calibration relation above using an electric field term E which is corrected for the relative number of ions in the sample.

11. The method of claim 10 wherein the step of determining the relative number of ions is accomplished by performing a Fourier transform on the output signal and summing abundances for all of the peaks in a given spectrum to provide a measure of the total number of ions.

12. The method of claim 10 wherein the step of determining the relative number of ions is accomplished by measuring the magnetron frequency for the ions contained in the cell.

13. The method of claim 10 wherein the sample consists of a single ion and wherein the step of calculating the relative number of ions is accomplished by measuring the output signal amplitude.

14. A method for performing calibrated sample measurements in an ion cyclotron resonance mass spectrometer of the type which has a cell into which a sample may be introduced, an ion generating source which produces ions which are trapped in the cell, a magnetic field produced about the cell, a plurality of electrode plates for exciting ion motion, and means for detecting motion of ions in the cell and providing an output signal indicative thereof, the method using the calibration relation $$m = k_1 B/f + k_2' i' T/f^2$$

where m is the mass of the ion to be measured, $k_1$ is a constant, B is the magnetic field, $k_2'$ is a constant, i' is the relative number of ions, T is the trapping voltage, and f is the measured frequency for that ion, the method comprising the steps of:

ionizing a calibrant compound and trapping the ionized calibrant compound in the cell of the ion cyclotron resonance mass spectrometer;
(b) exciting ions into coherent cyclotron motion and collecting at least two spectra of the calibrant compound from the output signal indicative of the motion of ions of the calibrant compound in the cell;
(c) determining the relative number of ions in each of the spectra;
(d) removing the calibrant compound from the cell and ionizing a sample to be analyzed and trapping the ionized sample in the cell;
(e) exciting ions into coherent cyclotron motion and collecting a spectrum of the sample to be analyzed;
(f) determining the relative number of ions i' with respect to the relative number of ions determined in the spectra from the sample to be analyzed; and
(g) determining the mass of the sample from the calibration relation above using the relative number of ions i' determined for the sample.

15. The method of claim 14 including the additional step of determining the values for $k_1$ and $k_2'$ by the method of least squares.

16. The method of claim 14 wherein the step of determining the relative number of ions is accomplished by performing a Fourier transform on the output signal and summing the abundances for all of the peaks in a given spectrum to provide a measure of the total number of ions.

17. The method of claim 14 wherein the step of determining the relative number of ions is accomplished by measuring the magnetron frequency for the ions contained in the cell.

18. The method of claim 14 wherein the sample consists of a single ion and wherein the step of determining the relative number of ions is accomplished by measuring the output signal amplitude.

19. A method for performing calibrated sample measurements in an cyclotron resonance mass spectrometer, of the type which has a cell into which a sample may be introduced, an ion generating source which produces ions which are trapped in the cell, means for producing a magnetic field in the cell, a plurality of electrode plates for exciting ion motion in the cell, and a means for detecting motion of ions in the cell and providing an output signal indicative thereof, the method using the calibration relation $$m = k_1 B/f + k_2'' T/f^2$$

where m is the mass of the ion to be measured, B is the magnetic field strength, $k_1$ is a constant, $k_2''$ is a constant related to cell geometry, T' is an effective trapping voltage which is a composite of the terms related to the trapping voltage and the total number of ions, and f is the measured frequency for that ion, the method comprising the steps of:

(a) ionizing a calibrant compound and trapping the ionized calibrant compound in the cell of the ion cyclotron resonance mass spectrometer;

(b) exciting ions into coherent cyclotron motion and collecting at least two spectra of the calibrant compound from the output signal indicative of the motion of ions of the calibrant compound in the cell;

(c) determining the relative number of ions in each of the spectra;

(d) removing the calibrant compound from the cell and ionizing a sample to be analyzed and trapping the ionized sample in the cell;

(e) exciting ions into coherent cyclotron motion and collecting a spectrum of the sample to be analyzed;

(f) determining the relative number of ions in the spectra from the sample to be analyzed; and (g) determining the mass of the sample from the calibration relation above using an effective trapping voltage T' which is a function of the actual trapping voltage and the relative number of ions in the sample.

20. The method of claim 19 wherein the step of determining the relative number of ions is accomplished by performing a Fourier transform on the output signal and summing the abundances for all of the peaks in a given spectrum to provide a measure of the total number of ions.

21. The method of claim 19 wherein the step of determining the relative number of ions is accomplished by measuring the magnetron frequency for the ions contained in the cell.

22. The method of claim 19 wherein the sample consists of a single ion and wherein the step of determining the relative number of ions is accomplished by measuring the output signal amplitude.

* * * * *

UNITED STATES PATENT AND TRADEMARK OFFICE

CERTIFICATE OF CORRECTION

PATENT NO. : 4,933,547

DATED : June 12, 1990

INVENTOR(S) : Robert B. Cody, Jr.

It is certified that error appears in the above-identified patent and that said Letters Patent is hereby corrected as shown below:

Column 2, line 17, "no. May 6, 1985," should be --no. 6, May, 1985,--.

Column 8, line 58, " $m=k_1B/f+k_2''T/f^2$ " should be -- $m=k_1B/f+k_2''T'/f^2$ --.

Column 14, line 18, insert --(a)-- before "ionizing".

Column 14, line 67, " $m=k_1B/f+k_2''T/f^2$ " should be -- $m=k_1B/f+k_2''T'/f^2$ --.

Signed and Sealed this

Third Day of August, 1993

*Attest:*

Michael K. Kirk

MICHAEL K. KIRK

*Attesting Officer*

*Acting Commissioner of Patents and Trademarks*